US005275217A

United States Patent [19]

Eakin

[11] Patent Number: 5,275,217

[45] Date of Patent: Jan. 4, 1994

[54] ONE-PIECE WALLET TO CARRY BILLS ON OUTSIDE

[76] Inventor: David A. Eakin, 916 Alton Woods Dr., Concord, N.H. 03301

[21] Appl. No.: 844,729

[22] Filed: Mar. 2, 1992

[51] Int. Cl.[5] ..... A45C 1/06

[52] U.S. Cl. ..... 150/132; 150/141; 150/147

[58] Field of Search ..... 206/37; 383/86; 150/131, 132, 136, 143, 146, 137, 145, 140, 141, 147

[56] References Cited

U.S. PATENT DOCUMENTS

| | | | |
|---|---|---|---|
| 467,760 | 1/1892 | Topham | 150/143 X |
| 779,742 | 1/1905 | Schultze | 150/132 |
| 781,948 | 2/1905 | Hegele | 150/131 X |
| 788,060 | 4/1905 | Otto | 150/131 |
| 833,834 | 10/1906 | Hille | 150/143 X |
| 1,761,809 | 6/1930 | Ancla | 206/37 R |
| 2,031,773 | 2/1936 | Halperin | 150/143 X |
| 2,443,392 | 6/1948 | Lampert | 150/140 |
| 2,629,419 | 2/1953 | Klein | 150/141 |
| 2,654,409 | 10/1953 | Cox | 150/132 X |
| 2,719,557 | 10/1955 | Bell | 150/146 X |
| 2,752,976 | 7/1956 | Goldstein | 150/141 |
| 4,286,639 | 9/1981 | Murphy | 383/86 X |
| 4,332,338 | 6/1982 | Christiansen | 150/143 X |

FOREIGN PATENT DOCUMENTS

| | | | |
|---|---|---|---|
| 384256 | 10/1923 | Fed. Rep. of Germany | 150/132 |
| 2928500 | 1/1976 | Fed. Rep. of Germany | 150/132 |
| 1510774 | 1/1968 | France | 150/132 |
| 2180 | of 1909 | United Kingdom | 150/131 |
| 18846 | of 1915 | United Kingdom | 150/136 |
| 19987 | of 1915 | United Kingdom | 150/132 |

*Primary Examiner*—Sue A. Weaver
*Attorney, Agent, or Firm*—William B. Ritchie

[57] ABSTRACT

An inside-out wallet designed to carry currency completely exposed on the outside face of the wallet, allowing for easy access to currency with pockets to carry credit cards. The wallet can be folded and conveniently and comfortably carried in a front pocket, eliminating a bulky object in the hip pocket. Access to the currency may be achieved without unfolding the wallet and the user can conveniently remove bills one at a time without disturbing other bills.

8 Claims, 3 Drawing Sheets

FIG. 1
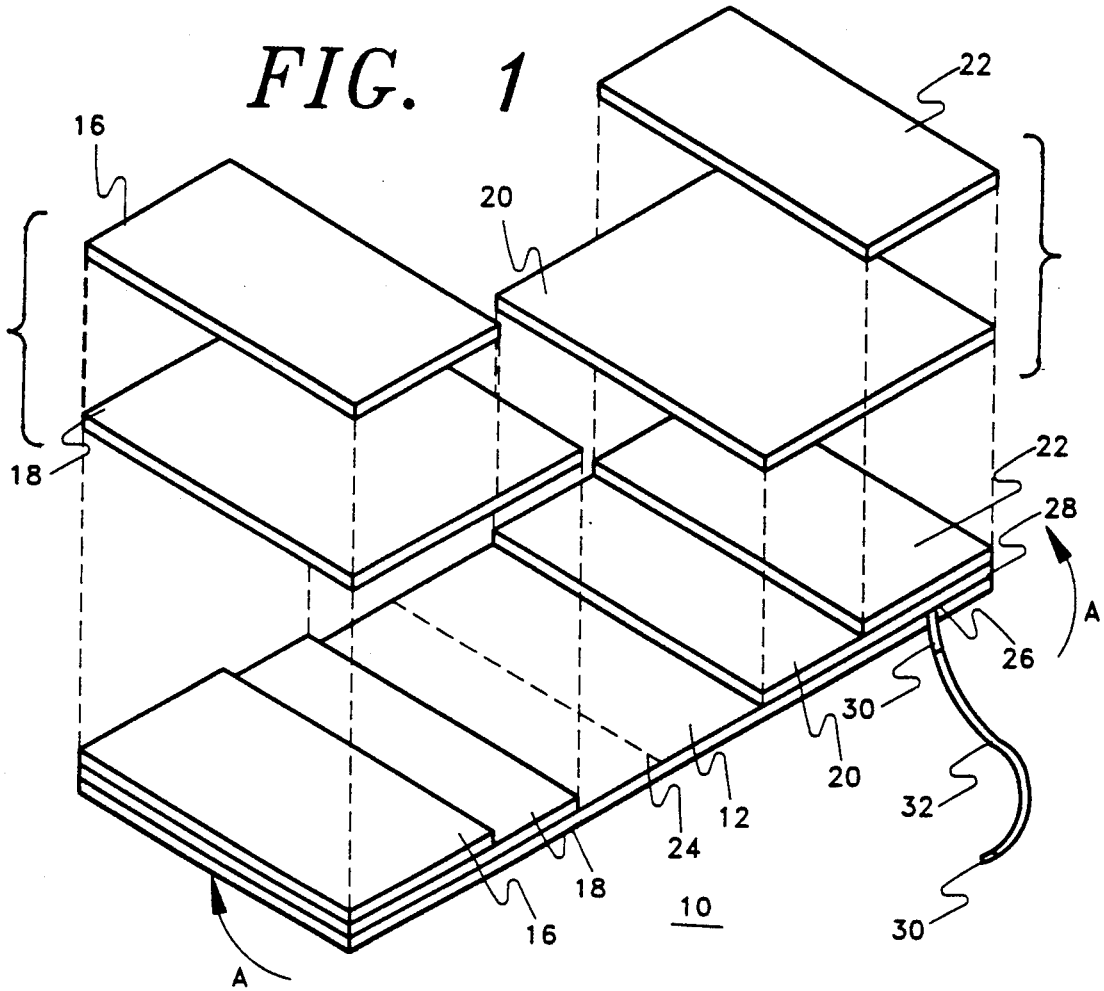
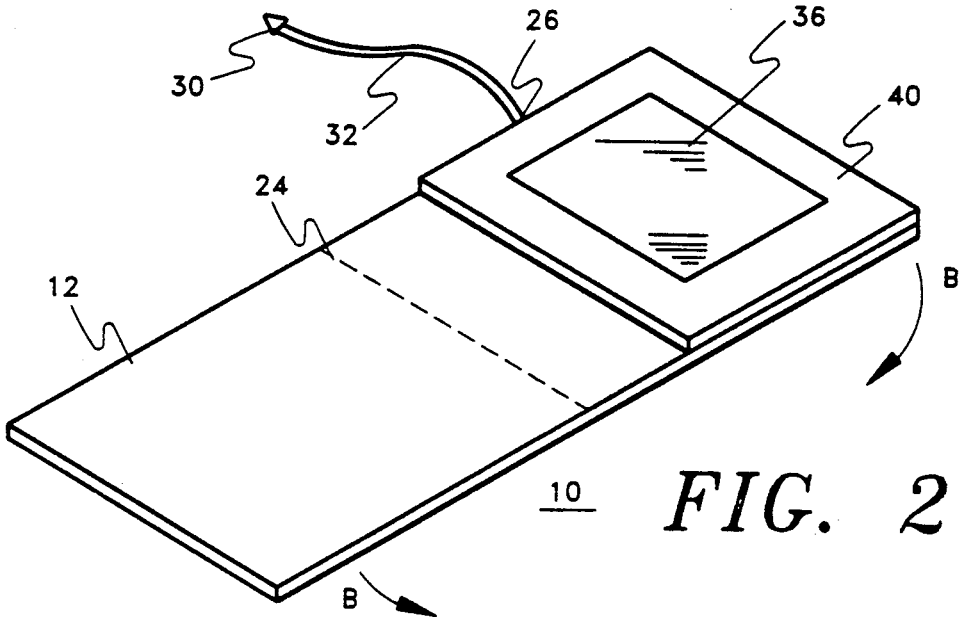
FIG. 2

FIG. 3
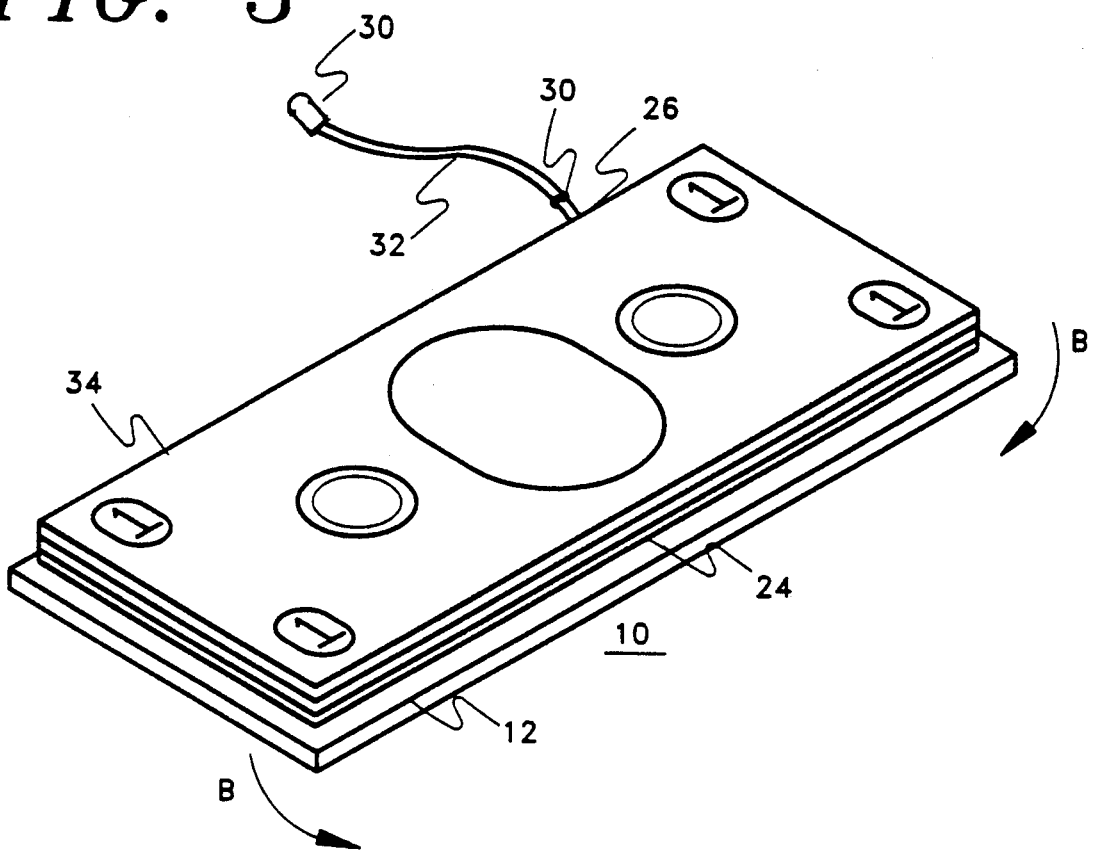
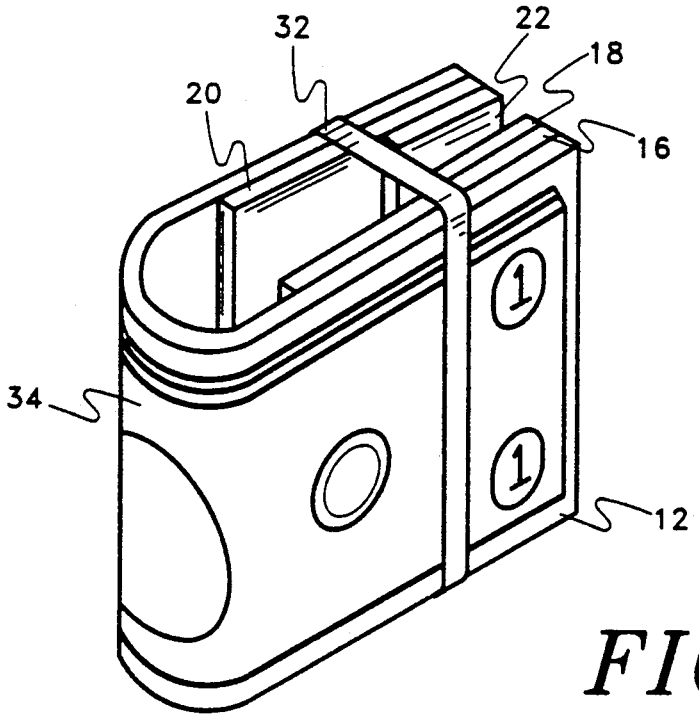
FIG. 4

ONE-PIECE WALLET TO CARRY BILLS ON OUTSIDE

BACKGROUND OF THE INVENTION

1. Field of the Invention

The invention relates to an inside out wallet providing a compact design that can be carried in a front pocket with paper money accessible on the outside and completely in view.

2. Description of the Related Art

Despite the numerous designs of wallets that have been developed over the years, there is no convenient, inexpensive wallet specifically designed to carry paper money completely exposed on the outside face of the wallet, allowing for easy access, and containing additional pockets to carry additional cards.

Standard billfold wallets contain bills inside the wallet. This requires the user to fold open the wallet and reach into some type of pocket to withdraw the desired bills. It is often hard to distinguish between dollar denomination and requires several steps to withdraw and insert bills. This type of wallet is typically designed to be carried in the hip pocket or in a suit coat pocket. It is unsuitable to carry in a front pocket, where it is less apt to be lost or pick-pocketed, due to its bulk.

For convenience, money clips are often used to hold bills together. They are less bulky than traditional wallets, however, money clips restrict the user from carrying additional cards, such as credit cards and a drivers' license.

U.S. Pat. No. 2,443,392, issued to Lampert, discloses a one-piece billfold with the bills partially exposed. The bills are partially contained within a pocket formed by an extension which is folded into position over the bills so that the bills are still constrained within an enclosed section. There are no individual compartments or pockets to hold additional cards.

U.S. Pat. No. 2,752,976, issued to Goldstein, discloses another wallet variation that has the bills partially exposed. Again, this wallet is designed to partially hold bills within a pocket and does not leave the bills completely exposed. To insert bills into the wallet, several flaps must be folded away. The bills are placed inside and the same flaps must be folded again over the bills. This process is complicated and time consuming. Furthermore, there are no individual compartments or pockets to hold additional cards.

U.S. Pat. No. 2,659,419, issued to Klein, discloses still another wallet variation that only exposes the end of the bills. A pocket flap must be drawn back to further expose the bills.

An efficient, inexpensive to manufacture, easy to use wallet specifically designed to carry paper money completely exposed on the outside face of the wallet is not found in the prior art.

SUMMARY OF THE INVENTION

It is an object of the invention to provide a wallet designed to carry paper money completely exposed on the outside face of the wallet.

It is another object of the invention to provide a wallet that can be conveniently and comfortably carried in a front pocket, eliminating the need to carry a bulky object in the hip pocket that is more likely to be lost or pick-pocketed.

It is also an object of the invention to provide a wallet that conforms to the body's contour and avoids the uncomfortable hardness of a metal money clip.

It is still another object of the invention to provide a wallet that expands its usage over that of a money clip to conveniently carry additional cards.

It is still another object of the invention to provide a wallet that allows the user to conveniently remove bills one at a time without disturbing other bills.

It is still another object of the invention to provide a wallet that is simple to manufacture, having less parts than conventional billfold style wallets.

It is still another object of the invention to provide a wallet that facilitates the removal and insertion of bills.

It is still another object of the invention to provide a wallet to provide an easier method to visually scan the bills and denominations available.

It is a final object of the invention to provide a wallet that is convenient, easy to handle and less expensive to produce than conventional billfold style wallets.

The invention is a wallet comprising a single rectangular blank of flexible material, with its length and width corresponding to the size of the paper money to be retained thereon. The blank has an edge along its length and has a currency side and a pocket side. A folding line across the width of said blank, adjacent to the middle of the length of said blank is also provided. The said pocket side has a plurality of inserts to form a corresponding number of pockets adapted to hold credit cards and similar-sized documents. The currency side of the blank is adapted to hold paper money completely exposed thereon. An elastic strap, having a permanent attachment end and a releasably attachable end is provided. The permanent attachment end is attached adjacent to the edge of said blank. When said blank is folded along said fold line with said pocket side folded upon itself, and when said elastic strap is stretched around the width of said folded blank with said releasably attachable end attached adjacent to the permanent attachment end of said strap, said paper money is restrained against said currency side of said wallet by said strap, with said paper money completely exposed, including both ends.

BRIEF DESCRIPTION OF THE DRAWINGS

FIG. 1 is an exploded view of the non-currency side of the unfolded wallet in accordance with the invention.

FIG. 2 is a view of the currency side of the unfolded wallet without currency in place in accordance with the invention.

FIG. 3 is a view of the currency side of the unfolded wallet with currency in place in accordance with the invention.

FIG. 4 is a isometric view of the folded wallet containing currency.

DETAILED DESCRIPTION OF THE INVENTION

Figure 5:
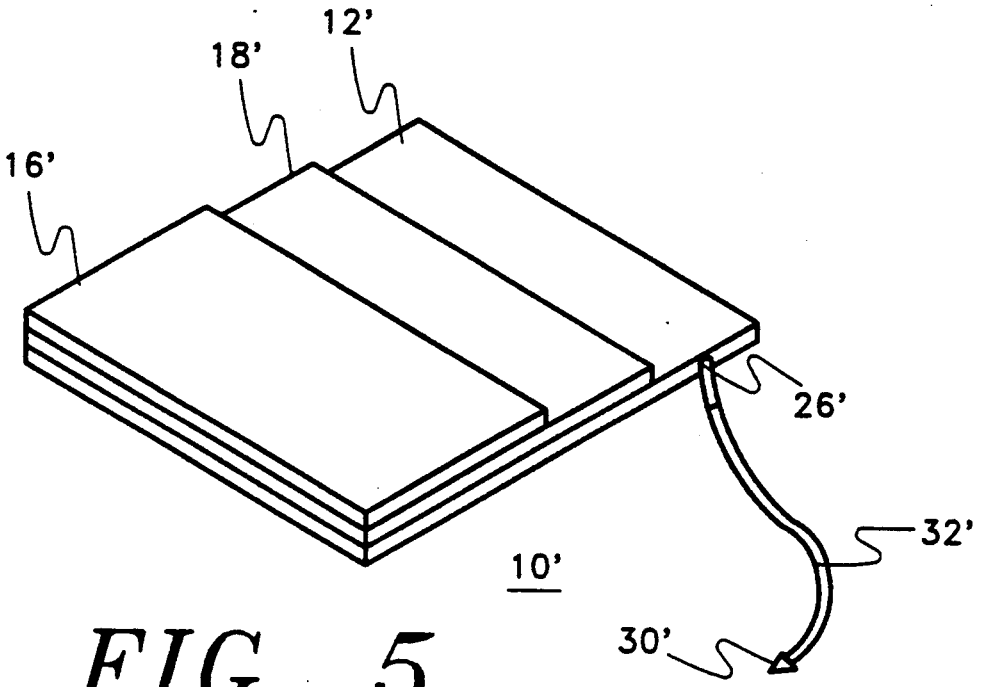
FIG. 5 is a view of the non-currency side of an alternative embodiment of the wallet in accordance with the invention.
Figure 6:
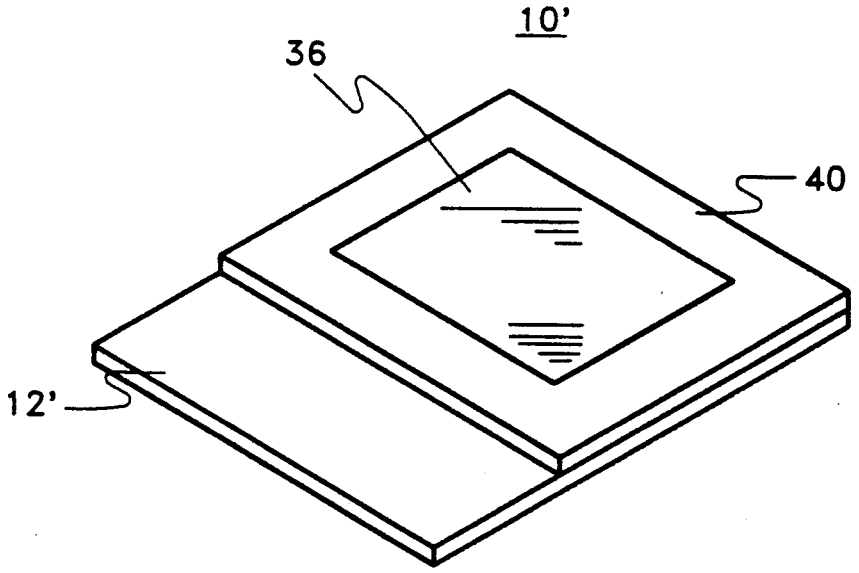
FIG. 6 is a view of the currency side of the alternative embodiment of the wallet with the optional window insert shown in FIG. 2.

FIG. 1 is an exploded view of the non-currency side of the unfolded wallet in accordance with the invention. The wallet 10 comprises a single blank 12 of material preferably measuring 7¼ inches in length and 3 inches wide and made of a flexible material such as leather, vinyl, canvas as well as other materials customarily used for wallet construction. Insert 18 is attached to blank 12 to form an inner pocket on the left side of the wallet. Insert 20 is attached to blank 12 to form an inner pocket on the right side. Preferably inserts 18 and 20 measure 3 inches in length and are attached to blank 12 by stitching, gluing or electronic welding, etc. The method selected is dependent upon the material selected. All such attachments methods are well known in the art.

Inserts 16, 18, 20 and 22 do not all have to be of the same material or even the same material as blank 12. For example, blank 12 could be leather, while inserts 16 and 18, 20 and 22 could be of canvas of varying colors for ornamental purposes.

Insert 16 is attached to insert 18 to form a second inner pocket on the left side. Insert 22 is attached to insert 20 to form a second inner pocket on the right side. Preferably inserts 16 and 22 measure 2¼ inches and are attached to the inserts 18 and 20. The wallet 10 is folded along dotted line 24 as directed by arrows A so that insert 16 is adjacent to insert 22.

Elastic 32 has one end permanently attached to insert 22 at attachment point 26, again using the attachments methods described above depending on the materials selected. Elastic 32 is preferably elastic material about ¼ inch wire. The length of elastic 32 must be sufficient to be stretched around the width of blank 12 back to attachment point 26. One of elastic 32 is permanently attached to wallet 10 at attachment point 26 at the edge of blank 12. While the exact location of point 26 is not critical, it should be placed closer to the end of wallet 10 than its middle which corresponds to fold line 24. Fastener 30 is used to fasten elastic 32 around wallet 10. One end of fastener 30 could be a hook type of fabric fastener attached to elastic 32 while the other end of elastic 32 would have the corresponding loop type of fabric fastener attached, e.g., VELCRO ®. Other types of fasteners well known in the art are also acceptable as shown in FIG. 3.

Attachment point 28 is an alternative point of attachment. In this situation, elastic 32 must be sufficiently long to be stretched around the length of folded blank 12 so that end 30 can then be attached at point 28.

FIG. 2 is a view of the currency side of the unfolded wallet 10 without currency in place in accordance with the invention. Optional insert 40 contains a see-through plastic section 36 and is attached to blank 12 on three sides to form a pocket. A picture ID can be slid into the formed pocket revealing the picture through the plastic holder. While only one see-through pocket section is shown to the right of fold line 24, an alternative embodiment would include the identical configuration to the left of fold line 24 as well.

FIG. 3 is a view of the currency side of the unfolded wallet with currency in place in accordance with the invention. Currency 34 is laid on top of blank 12 and held in place by elastic 32 which is wrapped around the currency as the wallet is folded along fold line 24 in the direction of arrows B. By having the currency on the outside of the wallet, the user can determine at a glance what currency is present by thumbing through the bills to reveal the amount of currency held on the wallet. Fastener 30 in this figure is shown as a metal hook fastened to the releasible end of elastic 32 with an eye at the permanent attachment end of elastic 32. Again, other easily released fasteners would also be suitable.

FIG. 4 is a isometric view of the folded wallet containing currency. Elastic 32 wraps completely around both sides of the wallet securing the wallet in a folded position. When elastic 32 is removed the wallet may be unfolded. Currency 34 can be easily drawn out from under elastic 32 without disturbing other bills when the wallet is in the folded position. The elastic can also be conveniently removed to further facilitate removal or addition of paper money. In both the folded and unfolded positions, bills can be conveniently removed one at a time.

FIG. 5 is a view of the non-currency side of an alternative embodiment of the wallet in accordance with the invention. In this embodiment, wallet 10' comprises blank 12' which is preferably ½ the length of blank 12 in the preferred embodiment. Therefore, only half the pockets, insert 18' and 16' are required. On the currency side of the wallet is at least one clear plastic window insert for holding an identification card. This embodiment is even less costly to produce and provides even less bulk for use in front pockets. Currency (not shown) is wrapped around the wallet 10' so that the currency is essentially folded in half and held in place by elastic 32'. As in the preferred embodiment, elastic 32' is stretched around wallet 10' such that end 30' is attached at attachment point 26', thus holding the currency in place yet permitting easy viewing and retrieval access.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A wallet comprising:

a single rectangular blank of flexible material, with its length and width corresponding to the size of the paper money to be retained thereon, said blank having a point of attachment, an edge along its length and having a currency side, a pocket side and a folding line across the width of said blank, adjacent to the middle of the length of said blank, with said pocket side having means forming a plurality of inserts to define a corresponding number of pockets adapted to hold credit cards and similar-sized documents, with said currency side dimensioned to hold paper money completely exposed thereon;

an elastic strap, having a permanent attachment end and a releasably attachable end, with attachment means for attaching said releasably attachable end to said point of attachment, said permanent attachment end attached adjacent to the edge of said blank, whereupon when said blank is folded along said fold line with said pocket side folded upon itself, and when said elastic strap is stretched around the width of said folded blank, said point of attachment is disposed such that with said attachment means attached to said point of attachment, said paper money is restrained against said currency side of said wallet by said strap, with said paper money completely exposed, including both ends.

2. The wallet of claim 1 further comprising at least one insert having a clear plastic window attached to said currency side of said blank, dimensioned to hold an identification document.

3. The wallet of claim 2 wherein said attachment means further comprises a hook and loop fastener.

4. The wallet of claim 2 wherein said attachment means comprises a metal clip and eye type of fastener.

5. A wallet comprising:

a single rectangular blank of flexible material, with its length corresponding to one half the length of the paper money to be retained thereon, and its width corresponding to the width of said paper money, said blank having a point of attachment, an edge along its length and having a currency side, a pocket side, with said pocket side having means forming a plurality of inserts to define a corresponding number of pockets adapted to hold credit cards and similar-sized documents, with said paper money completely exposed on said currency side and said pocket side;

an elastic strap, having a permanent attachment end and a releasably attachable end, with attachment means for attaching said releasably attachable end to said point of attachment, said permanent attachment end attached adjacent to the edge of said blank, whereupon when paper money is placed upon said currency side of said blank and is folded in half with the other half covering said pocket side of said blank and when said elastic strap is stretched around the width of said blank, said point of attachment is disposed such that with said attachment means attached to said point of attachment, said paper money is restrained against said currency side and said pocket side of said blank by said strap, with said paper money completely exposed, including both ends.

6. The wallet of claim 5 further comprising at least one insert having a clear plastic window attached to said currency side of said blank, dimensioned to hold an identification document.

7. The wallet of claim 6 wherein said attachment means comprises a hook and loop fastener.

8. The wallet of claim 6 wherein said attachment means comprises a metal clip and eye type of fastener.

* * * * *